US005766409A

United States Patent [19]

Krznarich et al.

[11] Patent Number: 5,766,409

[45] Date of Patent: Jun. 16, 1998

[54] APPARATUS FOR LEVELING AND SUPPORTING THE HOT PLATES IN A DOUBLE BACKER FOR CORRUGATED PAPERBOARD

[75] Inventors: Larry M. Krznarich, Park Falls; Carl R. Marschke, Phillips, both of Wis.

[73] Assignee: Marquip, Inc., Phillips, Wis.

[21] Appl. No.: 682,206

[22] Filed: Jul. 17, 1996

[51] Int. Cl.[6] ..... B31F 1/28

[52] U.S. Cl. ..... 156/470; 156/499

[58] Field of Search ..... 156/210, 470, 156/583.3, 583.9, 499, 462, 580; 100/211; 248/578, 581, 589, 600, 602, 180.1, 346.05, 346.06

[56] References Cited

U.S. PATENT DOCUMENTS 2,941,573 6/1960 Cassady ..... 156/60

3,444,029 5/1969 Renaud et al. ..... 156/583.3

5,417,394 5/1995 Knorr et al. .

*Primary Examiner*—Richard Crispino

*Attorney, Agent, or Firm*—Andrus, Sceales, Starke & Sawall

[57] ABSTRACT

Light weight fabricated metal hot plates in a double backer are initially leveled and maintained flat and coplanar against the forces of thermal distortion by utilizing a dense array of adjustable spring biased support assemblies attached to the underside of the hot plate and securing the plate to an underlying supporting framework. The support assemblies allow horizontal thermal deflection of the hot plate but hold the hot plate heating surfaces firmly against vertical deflection.

10 Claims, 3 Drawing Sheets

APPARATUS FOR LEVELING AND SUPPORTING THE HOT PLATES IN A DOUBLE BACKER FOR CORRUGATED PAPERBOARD

BACKGROUND OF THE INVENTION

The present invention relates to a double backer for the production of corrugated paperboard and, more particularly, to an apparatus and method for initially leveling and supporting the hot plates in the heating section of a double backer, and maintaining the heating surfaces of the hot plates coplanar against the forces of thermal distortion during operation.

In a typical double backer for corrugated paperboard, a liner web is brought into contact with the glued flute tips of a single face corrugated web, and the resulting freshly glued double face web is passed over the heated surfaces of a number of serially arranged hot plates to cause the starch-based glue to set and to dry the web of excess moisture. The hot plates are typically heated by steam supplied individually to each of the hot plates from a common supply system. Double face web travel over the hot plates may be provided by a wide driven holddown belt in direct contact with the upper face of the corrugated web and with the belt held in contact with the moving web by a series of ballast rollers or the like, all in a well known manner. Alternately, beltless holddown and ballast systems have been developed in which the wide driven holddown belt is eliminated and the double face web is pulled through the system by another web drive device, such as a downstream vacuum belt.

For many years, the hot plates for a double backer have comprised heavy cast iron steam chests which, though suffering many operational deficiencies such as slow temperature response and bowing from thermal distortion, have been found difficult to replace with more efficient and less expensive heating sections. U.S. Pat. No. 5,501,762 discloses a hot plate system for a double backer in which the hot plates are fabricated of thin metal sections and include non-ferrous heating surfaces of high heat transfer efficiency. These hot plates include a lower supporting frame with anchoring and holddown devices to prevent vertical movement of the lateral edges of the hot plates as a result of thermal expansion, but to allow lateral movement thereof, all in a manner to maintain the heating surfaces of the hot plates coplanar. This thin hot plate construction has provided significant improvements over heavy cast iron steam chests and similar fabricated steel constructions, but still exhibits certain problems related to thermally induced plate distortion. U.S. patent application Ser. No. 543,202, filed Oct. 13, 1995, discloses a fabricated hot plate, including an embodiment in which a series of rectangular section tubes are joined side-by-side to define a hot plate. The tubes are preferably oriented in the cross machine direction and include steam supply and condensate return headers attached to the lateral opposite edges. This hot plate system also provides rapid thermal response and efficiency, but continues to exhibit difficulty in maintaining heating surface flatness in the face of the inevitable thermal expansion and contraction caused by heating and cooling.

SUMMARY OF THE INVENTION

In accordance with the present invention, a method and apparatus are provided for leveling and supporting the hot plates in a double backer which is particularly effective for use with relatively lightweight fabricated metal hot plates. The leveling and support apparatus of the present invention is mounted on a supporting framework which underlies and is spaced vertically below the hot plates. An array of adjustable hot plate support assemblies interconnects each hot plate and the supporting framework. Each of the adjustable support assemblies includes a downwardly depending holddown rod which is attached at its upper end to the underside of the hot plate, a tubular sleeve positioned coaxially over the holddown rod and provided at its lower end with an adjustable attachment to the supporting framework for vertical positioning with respect thereto to place the upper end of the sleeve in bearing contact with the underside of the hot plate, and a resilient axially biased connection between the lower end of the holddown rod and the lower end of the tubular sleeve which permits relative thermally induced movement therebetween while maintaining bearing contact between the sleeve and the hot plate.

The apparatus of the present invention is particularly adapted for use with an arrangement of generally rectangular hot plates which are positioned longitudinally through the double backer in closely spaced relation to define the corrugated paperboard heating section. In this embodiment, the support assembly array comprises spaced rows of assemblies, each row including a plurality of support assemblies for each hot plate, with each row extending the length of the heating section. Preferably, selected rows of the support assembly array which are adjacent the lateral edges of the hot plates are more closely spaced than the rows inwardly thereof.

In the presently preferred embodiment, the supporting framework comprises a longitudinal supporting beam for each row of support assemblies. Each beam extends the length of the heating section and the supporting beams are, in turn, supported by laterally extending, longitudinally spaced cross members. Each of the supporting beams preferably comprises a box beam of generally rectangular cross section, each of which beams includes a lower plate in supporting engagement with the cross members and an upper plate. The tubular sleeve of each support assembly extends through a clearance hole in the upper plate of the box beam and has a threaded lower end adjustably mounted in a tapped hole in the lower plate. The axially biased connection preferably comprises a compression spring captured between the lower ends of the holddown rod and the tubular sleeve.

In the preferred embodiment, the hot plates are provided with generally flat lower surfaces to which are secured attachment strips for each of the rows of support assemblies, each of which strips is aligned with a row of support assemblies. Each of the attachment strips provides the attachment for the holddown rods and a bearing surface for the tubular sleeves of the plurality of support assemblies in the row.

In accordance with the method of the present invention, the coplanar upper heating surfaces of the hot plates are leveled and supported by: positioning a support framework under the heating section; providing each hot plate with laterally spaced, longitudinally extending rows of holddown rods which are secured to the underside of the hot plate and extend vertically downwardly; enclosing each holddown rod in a coaxial tubular sleeve which has a threaded lower end connected to a corresponding threaded connection in the supporting framework to provide adjustable vertical movement of the sleeve; providing spring biased connections between the lower free ends of the holddown rods and the lower ends of the tubular sleeves to bias the rods downwardly and hold the hot plates against the upper ends of the sleeves; and, adjusting each of the sleeves in their respective threaded connections to bring the heating surfaces into common coplanar orientation. The method preferably includes the step of securing attachment strips to the underside of each hot plate to provide attachment of the holddown rods and bearing surfaces for the upper ends of the sleeves.

DETAILED DESCRIPTION OF THE PREFERRED EMBODIMENT

Figure 1:
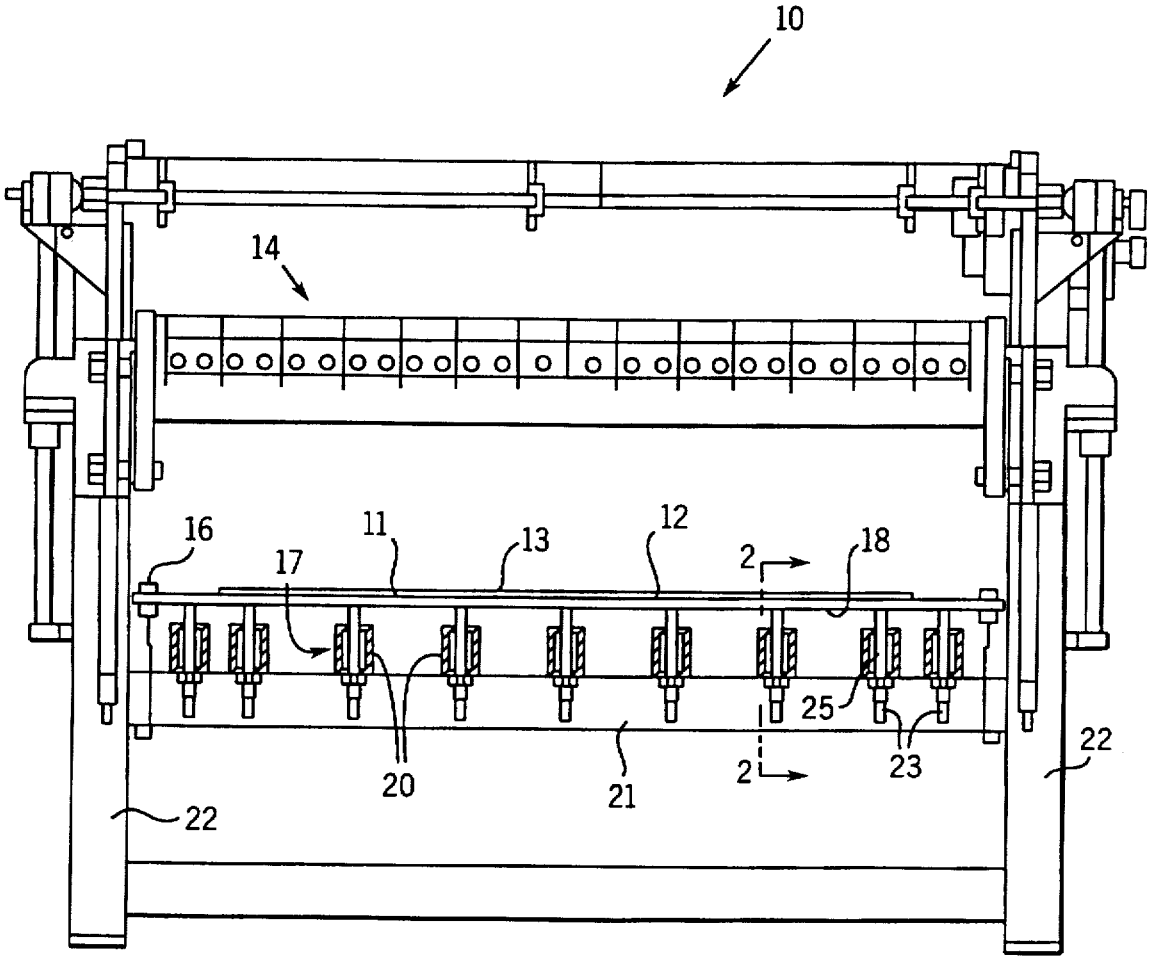
FIG. 1 is a vertical end view of the apparatus of the subject invention mounted on a double backer and viewed in the longitudinal machine direction of corrugated web movement therethrough.
Figure 2:
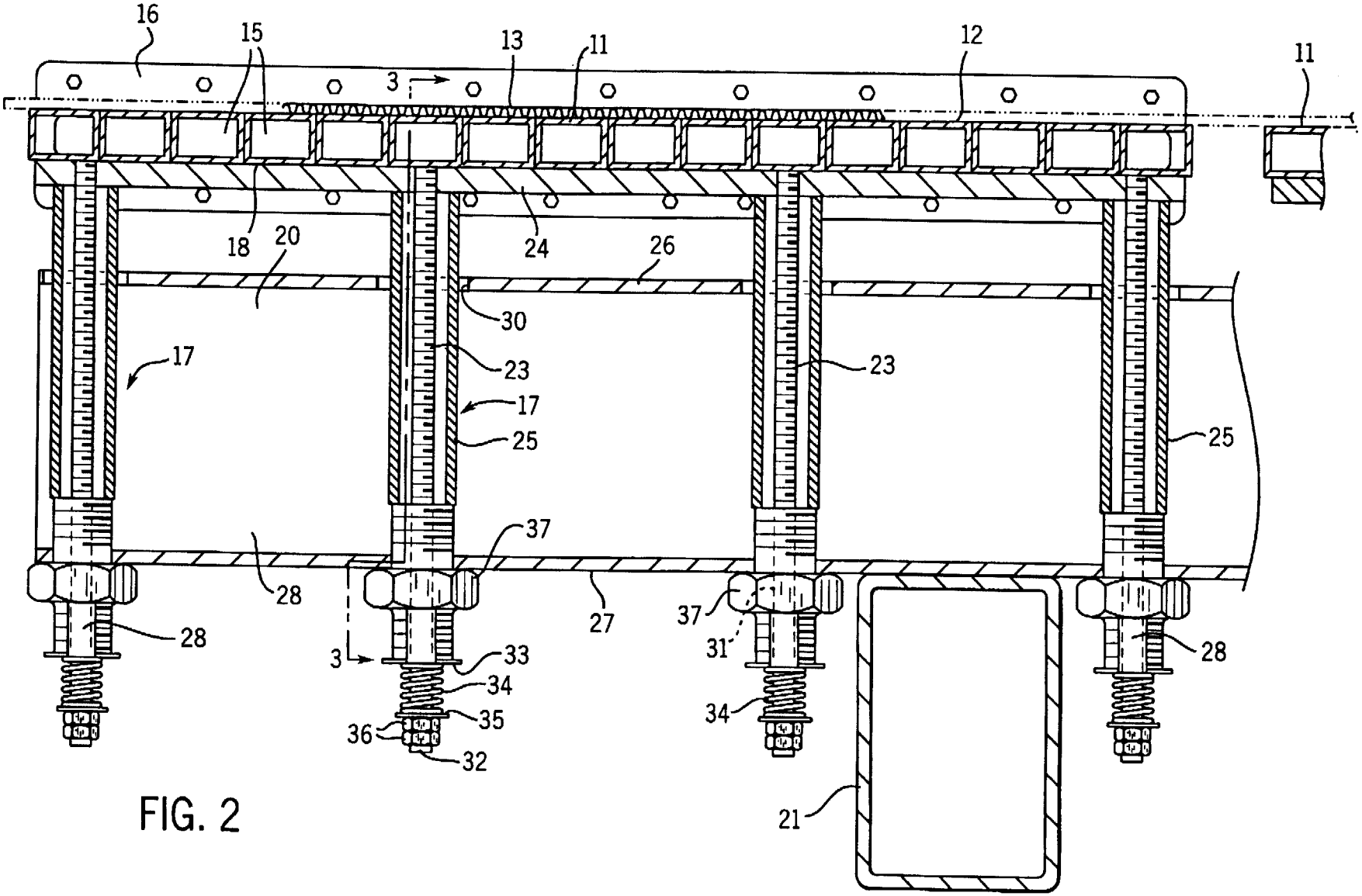
FIG. 2 is an enlarged sectional detail taken on line 2—2 of FIG. 1.
Figure 3:
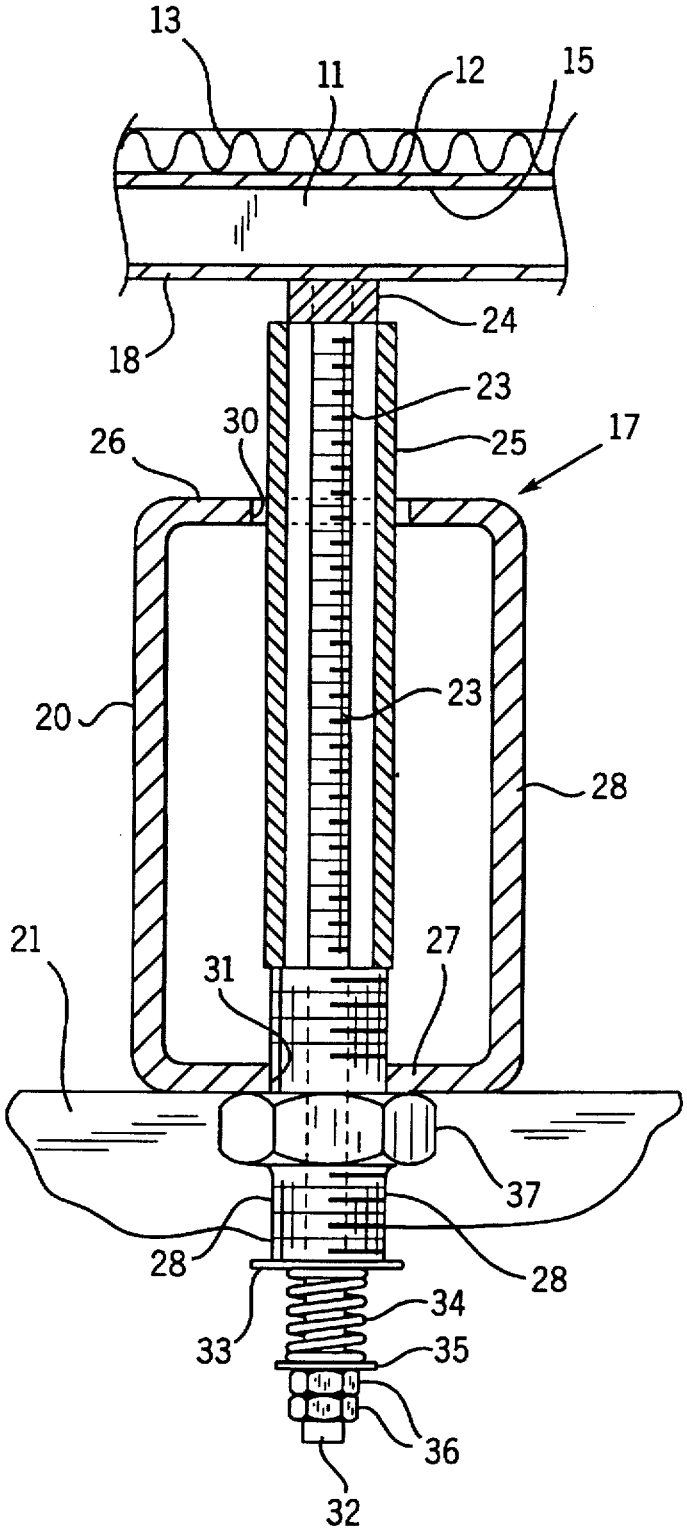
FIG. 3 is a sectional detail taken on line 3—3 of FIG. 2.

Referring initially to FIGS. 1 and 2, a double backer 10 includes a series of hot plates 11 which are arranged to provide coplanar upper heating surfaces 12 over which a corrugated paperboard web 13 is driven, as by a downstream vacuum belt or the like (not shown). An upper web holddown apparatus 14 (which is shown in FIG. 1 in its raised inoperative position) provides a uniform holddown force to the upper surface of the web 13 traveling over the hot plates to facilitate rapid setting of the glue and uniform drying of the web. The heating surfaces 12 of the hot plates are rectangular in plan view and are relatively short in length in the machine direction (e.g. about 2 feet or 0.6 m) and considerably longer in width in the cross machine direction (e.g. about 8 feet or 4.8 m). The long width of the hot plates is necessary to accommodate the maximum width of corrugated paperboard web which may be produced on a corrugator. As many as 18 to 20 hot plates may be positioned end to end in the longitudinal machine direction to provide a length of heating section typically utilized.

In lieu of heavy cast iron steam chests, typical of the prior art, the apparatus of the present invention is particularly adapted for use with thin fabricated metal hot plates 11 which are much more thermally responsive and efficient than cast iron steam chests. However, these relatively light weight and thin hot plates are subject to significant thermal distortion when heated, including upward bowing of the ends and edges, horizontal growth in both the cross machine and machine directions and general distortion of the heating surface 12. As is best is seen in FIG. 2, the hot plate 11 is fabricated from a series of rectangular section metal tubes 15 which are welded or otherwise joined side-to-side to form a hot plate of the desired machine direction length (e.g. 2 feet). The tubes 15 from which the hot plate is fabricated run the full width of the apparatus in the cross machine direction and are thus typically about 8 feet in length. The open ends of the tubes 15 on opposite lateral edges of the hot plate are closed with appropriate steam supply and condensate collecting headers 16, all in a manner described in more detail in pending application Ser. No. 543,202, identified above. The top of the hot plate 11 is suitably ground and finished to provide a smooth planar heating surface 12. The apparatus of the present invention is intended to establish coplanar relationship between all hot plate heating surfaces and to secure those surfaces against movement out of that coplanar orientation as a result of thermally induced movement during double backer operation.

The hot plates 11 are supported by an array of adjustable support assemblies 17 which extend between the lower surfaces 18 of the hot plates and a series of longitudinally extending supporting beams 20. The supporting beams 20 run the full length of the double backer heating section and are, in turn, supported by a series of laterally extending, longitudinally spaced cross members 21 which extend between opposite main side frame members 22 of the double backer. In the preferred embodiment, the supporting beams 20 comprise tubular box beams of rectangular cross section, but other sections could be used as well.

The support assemblies are disposed in laterally spaced rows extending the length of the hot plates and, in each row, there are sufficient support assemblies to provide two or more for each hot plate. In the presently preferred embodiment for a full 96 inch (4.8 m) double backer, there are nine rows of support assemblies (i.e. nine supporting beams 20) with four assemblies 17 in each portion of a row underlying one hot plate 11. Thus, each hot plate in this embodiment is supported by 36 adjustable support assemblies 17. The beams 20 which support the support assemblies 17 and define the rows thereof are equally spaced laterally in each direction from a central row, except for the outermost rows on each side which are more closely spaced. For example, the inner rows may be spaced at about 12 inches (about 30 cm), whereas the two outermost rows may be spaced at about 7 inches (about 18 cm). This provides a higher concentration of support and holddown assemblies 17 at the lateral edges of the hot plates which are subject to the greatest thermal distortion.

Each support assembly includes a long threaded holddown rod 23, the upper end of which is threaded into a suitably tapped hole in an attachment strip 24 welded or otherwise secured to the lower surface 18 of the hot plate. One attachment strip 24 is provided for each row of support assemblies and, thus, in the embodiment described, there are nine attachment strips on the underside of each hot plate. A tubular sleeve 25 is placed coaxially over each holddown rod 23 and is somewhat shorter in axial length than the rod. Each supporting beam 20, which as indicated is preferably in the form of a rectangular box beam, includes an upper plate 26 and a lower plate 27 integrally joined by opposite side webs 28. For each support assembly 17, the supporting beam 20 is provided with a clearance hole 30 in the upper plate 26 and a tapped hole 31 in the lower plate 27. At least the lower end of the tubular sleeve 25 is provided with a threaded OD corresponding to the tapped hole 31 such that the tubular sleeve 25 may be inserted vertically through the clearance hole 30 and threaded into the lower plate 27. The downwardly depending holddown rod 23 extends coaxially through the sleeve 25 and, with the attachment strip 24 in engagement with the upper end of the tubular sleeve 25, the lower end 32 of the holddown rod 23 extends beyond the threaded lower end of the tubular sleeve. The lower end 32 is resiliently secured to the lower end of the sleeve with an axially biased connection which includes a washer 33, a high compression constant spring 34, a lower washer 35 and a pair of jam nuts attached to the threaded lower end 32 of the holddown rod 23. A large upper jam nut 37 secures the adjusted position of the tubular sleeve in the lower plate 27, as will be described in greater detail.

The assembly of each hot plate 11 to its respective supporting beams 20, via the intermediary of the adjustable support assemblies 17, is preferably accomplished as follows. Each of the tubular sleeves 25 is inserted through the clearance hole 30 in the upper plate 26 of the beam and the lower end of the tube is threaded into the tapped hole 31 in the lower plate 27. Each tubular sleeve 25 is threaded to approximately the same vertical position with respect to the beam and the large upper jam nut 37 is threaded onto the lower end of the sleeve, but at this time not turned into locking engagement with the underside of the lower plate 27. The holddown rods 23 are threaded into and secured tightly to the attachment strips 24 and, with all sleeves 25 and holddown rods 23 attached as indicated, the hot plate is brought downwardly to direct the rods into the sleeves until the respective attachment strips 24 are resting on the upper ends of the sleeves. The washer 33, spring 34, lower washer 35 and jam nuts 36 are placed on the threaded lower end of each of the rods 23 and the uppermost of the jam nuts 36 is tightened to place the spring 34 into a predetermined amount of compression, the other of the jam nuts 36 is then turned into locking engagement with the one above. Pre-compression of the spring 34 causes the holddown rod to pull the attachment strip 24, and thus the hot plate, firmly against the upper surface of the tubular sleeve 25. By using levels and suitable measuring devices, each hot plate heating surface 12 is leveled by turning the sleeve 25 in the tapped hole in the lower plate of the supporting beam 20 and, with similar adjustments of the tubular sleeves of the other hot plates, the heating surfaces 12 are positioned in a coplanar orientation. To facilitate sleeve adjustment, the threaded lower ends are provided with suitable flats 29.

As indicated previously, the relatively light section of the fabricated metal hot plate of the present invention is subject to more uneven thermal distortion than the heavy cast iron steam chests of the prior art. The support assemblies 17 of the present invention restrain the hot plates against vertical distortion while allowing unrestrained thermal expansion both laterally and longitudinally. The high compression constant of the springs 34 and the fairly dense array of support assemblies 17 for each hot plate, secure the hot plates against virtually all vertical deflection. As the hot plate and the supporting assemblies heat up, the holddown rods 23 will tend to expand and lengthen. The biased spring connections allow relative axial movement of the holddown rod with respect to the tubular sleeve 25 while retaining the hot plate firmly against the upper end of the sleeve. As the hot plates are heated from ambient to normal operating temperature, the hot plate will increase in width in the cross machine direction by about ¼ inch (about 6 mm) and will also expand somewhat less in the shorter machine direction. The clearance hole 30 in the upper plate 26 of the supporting beam, combined with the lengths of the holddown rod 23 and sleeve 25 allow the hot plate to expand freely in the horizontal direction without vertical deflection of the heating surface 12. The contact area between the upper ends of the tubular sleeves 25 and the narrow attachment strips 24 against which the sleeves bear minimizes the conductive heat transfer to the supporting frame. If desired, a heat transfer medium may be circulated through the cross members 21 to maintain the entire supporting framework at a uniform temperature. The high compression constant springs 34 may be conventional die springs, and the use of these springs in the support assemblies 17 of the present invention have been found capable of maintaining the flatness of the hot plates within a few thousandths of an inch over the full range of hot plate operating temperatures.

I claim:

1. A double backer corrugating device having a leveling and support apparatus for hot plates in the double backer, said apparatus comprising:

a supporting framework underlying and spaced vertically below the hot plates;

an array of adjustable hot plate support assemblies interconnecting each hot plate and the supporting framework, each support assembly including:

a downwardly depending holddown rod attached at its upper end to an underside of a hot plate;

a tubular sleeve disposed coaxially over said rod with its lower end having an adjustable attachment to said supporting framework for vertical positioning with respect thereto to place an upper end of said sleeve in bearing contact with the underside of the hot plate; and, a resilient device providing an axially biased connection between a lower end of the holddown rod and the lower end of the tubular sleeve to permit relative movement therebetween.

2. The apparatus as set forth in claim 1 wherein the hot plates are generally rectangular and are positioned longitudinally closely spaced to define a heating section, and wherein the support assembly array comprises laterally spaced rows of assemblies, each row extending the length of the heating section and including a plurality of support assemblies for each hot plate.

3. The apparatus as set forth in claim 2 wherein each of said hot plates includes:

a generally flat lower surface, an attachment strip secured to said lower surface and aligned with a row of support assemblies;

each attachment strip providing the attachment for the holddown rods and a bearing surface for the tubular sleeves of the plurality of support assemblies for said row.

4. The apparatus as set forth in claim 2 wherein selected rows of the support assembly array adjacent lateral edges of the hot plates are more closely spaced than rows inwardly thereof.

5. The apparatus as set forth in claim 2 wherein said supporting framework comprises:

a longitudinal supporting beam for each row of support assemblies, each supporting beam extending the length of the heating section; and, laterally extending, longitudinally spaced cross members supporting said beams.

6. The apparatus as set forth in claim 5 wherein each of said supporting beams comprises a box beam of generally rectangular cross section, including a lower plate in supporting engagement with said cross members and an upper plate.

7. The apparatus as set forth in claim 6 wherein the tubular sleeve of each support assembly extends through a box beam between a clearance hole in the upper plate and a tapped hole in the lower plate, and said adjustable attachment comprises a threaded lower end on said sleeve for said tapped hole.

8. The apparatus as set forth in claim 7 wherein said axially biased connection comprises a compression spring captured between the lower ends of said holddown rod and said tubular sleeve.

9. A double backer corrugating device having a leveling and support apparatus for a series of longitudinally extending closely spaced hot plates defining a heating section in the double backer, said apparatus comprising:

a supporting framework underlying and spaced vertically below the hot plates;

an array of laterally spaced rows of adjustable hot plate support assemblies interconnecting each hot plate and the supporting framework, each support assembly including:

a downwardly depending holddown rod attached at its upper end to an underside of a hot plate;

a tubular sleeve disposed coaxially over said rod with its lower end having an adjustable attachment to said supporting framework for vertical positioning with respect thereto to place an upper end of said sleeve in bearing contact with the underside of the hot plate; and, a high compression constant coil spring adjustably interconnecting a lower end of the holddown rod and the lower end of the tubular sleeve to permit relative movement therebetween while holding the hot plate in bearing contact with said sleeve.

10. A double backer corrugating device having a leveling and support apparatus for hot plates in the double backer, said apparatus comprising:

a supporting framework underlying and spaced from the hot plates;

an array of vertically disposed tubular members for each hot plate, said members having lower ends connected to the frame for vertical leveling adjustment and upper ends in supporting contact with an underside of a hot plate;

elongate holddown members having upper ends secured to undersides of the hot plates, each holddown member extending downwardly through a corresponding tubular member; and, resilient means providing axially biased adjustable connections between lower ends of said holddown members and lower ends of corresponding tubular members for imposing a holddown force on said hot plates and for permitting relative movement between a holddown member and a corresponding tubular member.

* * * * *